US005323928A

United States Patent [19]

Stevens

[11] Patent Number: 5,323,928

[45] Date of Patent: Jun. 28, 1994

[54] DYSPHAGIA CUP

[76] Inventor: Barry A. Stevens, 1039 Madison Ave. North, Bainbridge Island, Wash. 98110

[21] Appl. No.: 946,743

[22] Filed: Sep. 16, 1992

[51] Int. Cl.[5] ..... A47G 19/22

[52] U.S. Cl. ..... 220/703; 220/710.5; 220/DIG. 13; 206/217; D7/536; 222/571

[58] Field of Search ..... 220/703, 704, 710.5, 220/DIG. 13; 206/217; D7/535, 536; 222/571, 572

[56] References Cited

U.S. PATENT DOCUMENTS

| | | | |
|---|---|---|---|
| D. 29,814 | 12/1898 | Williams . | |
| D. 29,815 | 12/1898 | Williams . | |
| D. 70,369 | 6/1926 | Johnson . | |
| D. 151,431 | 10/1948 | Cooper et al. | D36/8 |
| D. 163,117 | 5/1951 | Hobbs | D44/21 |
| D. 165,782 | 1/1952 | Parker, Jr. | D44/9 |
| D. 168,218 | 11/1952 | Falk | D44/9 |
| D. 168,784 | 2/1953 | Del Mas | 220/703 |
| D. 169,235 | 4/1953 | Backus | D44/9 |
| D. 186,037 | 9/1959 | Stageberg | D44/9 |
| D. 197,106 | 12/1963 | Laubsch | D83/1 |
| D. 219,675 | 1/1971 | Davis | D44/9 |
| D. 220,845 | 6/1971 | Mascetti, Jr. | D44/9 |
| D. 220,966 | 6/1971 | Bateman | D44/9 |
| D. 222,732 | 12/1971 | Howard | D44/9 |
| D. 225,432 | 12/1972 | Gulotta | D44/9 |
| D. 240,287 | 6/1976 | Sarpaneva | D7/11 |
| D. 285,515 | 9/1986 | Papciak | D7/6 |
| D. 286,966 | 12/1986 | Ritman | D7/9 |
| D. 290,435 | 6/1987 | Manton et al. | D7/9 |
| D. 297,493 | 9/1988 | Ritman | D7/9 |
| D. 322,539 | 12/1991 | Under | D7/545 |
| 497,940 | 5/1893 | Bacon, Jr. | 220/703 |
| 2,803,375 | 8/1957 | Meshberg | 220/703 |
| 3,134,523 | 5/1964 | Hostetter | 220/703 |
| 4,016,998 | 4/1977 | Finch . | |
| 4,235,348 | 11/1980 | Watson | 220/703 |
| 4,408,644 | 10/1983 | Svantesson | 150/55 |

*Primary Examiner*—Joseph Man-Fu Moy
*Attorney, Agent, or Firm*—Christensen, O'Connor, Johnson & Kindness

[57] ABSTRACT

A drinking cup 10 for assisting swallowing has a hollow container portion 12 including a base 18 and an upwardly extending, elliptically-shaped sidewall 20. The sidewall defines an elliptical aperture 32 at its apex. The inner surface 26 of the sidewall defines an ellipse from a cross-sectional perspective at substantially all elevations between the aperture and a point proximate to the base, each cross section being taken along a plane disposed parallel to a plane defined by the aperture. The elliptical aperture is sized to accommodate a person's nasal bridge during drinking such that substantial backwards angulation of the head is not required. The cup includes a handle 16 disposed 90° out from the major axis of the elliptical aperture. People with dysphagia and/or arthritis are expected to benefit especially from the features of the present invention.

8 Claims, 4 Drawing Sheets

DYSPHAGIA CUP

FIELD OF THE INVENTION

The present invention relates to drinking cups, and more particularly, to drinking cups for people suffering from dysphagia or who have problems holding the handle of a conventional cup.

BACKGROUND OF THE INVENTION

Drinking cups are generally comprised of a container portion for holding the desired liquid and a handle for the person using the cup to hold on to. Generally, in order to be able to use a conventional drinking cup, a person must angulate his or her head backwards to avoid spilling of the fluid contents of the cup. This spilling occurs partly because conventional cups, in almost all cases, have a cylindrically-shaped container which does not provide sufficient clearance for the user's nose. In order to tip the cup to a degree sufficient to allow fluid, particularly thick, viscous fluids, to flow toward the mouth, the user is required to angulate his or her head while drinking. People suffering from dysphagia, a condition associated with difficulty in swallowing, often have trouble swallowing when the head is tilted due to a tendency to aspirate fluid into the lungs. This is sometimes a condition associated with having a stroke, head injury, or other neurological disorders and aging. Additionally, people so afflicted often encounter problems with liquid spillage when drinking from conventional cups due to the large radius of the rim.

It is known that swallowing in people suffering from dysphagia may be enhanced if the head is not angulated rearwardly while drinking. In an attempt to take advantage of this, conventional "nose-cups" have been designed which include a container part whose inner wall is circular in shape, but which is provided with a cut-out on the rim to accommodate the nose of the user, so that drinking can be accomplished while the user's head remains substantially vertical. However, such cups have an unusual appearance, which some users may find undesirable and thus avoid using. Additionally, such conventional "nose-cups" have cylindrical inner walls which do not facilitate controlled fluid flow, tending to lead to fluid spillage or the inability to empty cup of thicker fluids.

Conventional drinking cups also generally have small handles that accommodate only a few fingers of an average adult user. consequently, many older people have trouble holding on to such conventional drinking cups. These people may require the use of all four fingers on one hand or may need to use the palm of one or both hands in order to be able to elevate a drinking cup. This is especially true in the case of people with arthritis, who lack strength and often have gnarled fingers which may not securely grip the handle of conventional cups. The resulting instability may often lead to liquid spillage during drinking.

SUMMARY OF THE INVENTION

The present invention provides a drinking cup for assisting swallowing, which includes a hollow container portion having a base and an upwardly extending sidewall. The sidewall defines an elliptical aperture at its apex. The inner surface of the sidewall defines an ellipse from a horizontal cross-sectional perspective at substantially all elevations between the aperture and a point proximate to the base of the container portion. The aperture is dimensioned so as to accommodate a person's nasal bridge during drinking, so that substantial backwards angulation of the person's head is not required, and preferably no backwards angulation is required.

In a further aspect of the present invention, the container portion is formed so that the ratio of the major axis to the minor axis of the ellipses formed by the inner sidewall decreases in a direction from the aperture to the base of the container portion. In other words, the major axes of the ellipses, when measured at various elevations moving down the container portion, decrease in length at a greater rate than do the minor axes. The sidewalls thus form an increasingly circular shape toward the bottom of the inside of the container portion, with the point of greatest circularity being near the bottom.

In addition to providing clearance for the user's nose, the special elliptical shape of the inner sidewall of the container portion causes fluids to be funneled into the center of the user's mouth. This occurs because of the more elongated nature of the ellipses near the aperture, which form an increasingly narrow channel through which the contained liquid must travel when the cup is angulated during drinking. This directing of the fluids to the center of the user's mouth, and small radius of the cup at either narrow end of the aperture for better sealing to the user's lips, decreases the risk of liquid spillage and the loss of control in the mouth. This effect is particularly true for thicker fluids, which can still be funneled to the user's mouth without an undesirable degree of head angulation.

In another aspect of the present invention, the handle of the cup includes a vertical center segment and horizontal, parallel top and bottom segments projecting from either end of the center segment. The top and bottom segments are attached to the outer sidewall of the container portion at points adjacent to the aperture and the base, respectively. Since the ends of the handle are attached to the extreme top and bottom of the container portion, there is sufficient room inside the handle to accommodate four fingers and/or the palm of an average adult user's hand in a vertical direction. Additionally, the vertical center segment of the handle, which connects the top and bottom segments, is spaced outward from the container portion sufficiently far to allow at least two fingers of such a person to be inserted horizontally. This is useful for elderly users, particularly those with arthritis, who often have stiff joints and may need to use all of their fingers when lifting a drinking cup. Additionally, adequate room is provided between the handle and container for the user to hook a bent thumb or finger around the handle and securely lift the cup. The width of the handle in a direction tangential to the container portion and weight distribution of the cup adds stability and further alleviates the risk of fluid spillage due to the lack of rotational control.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
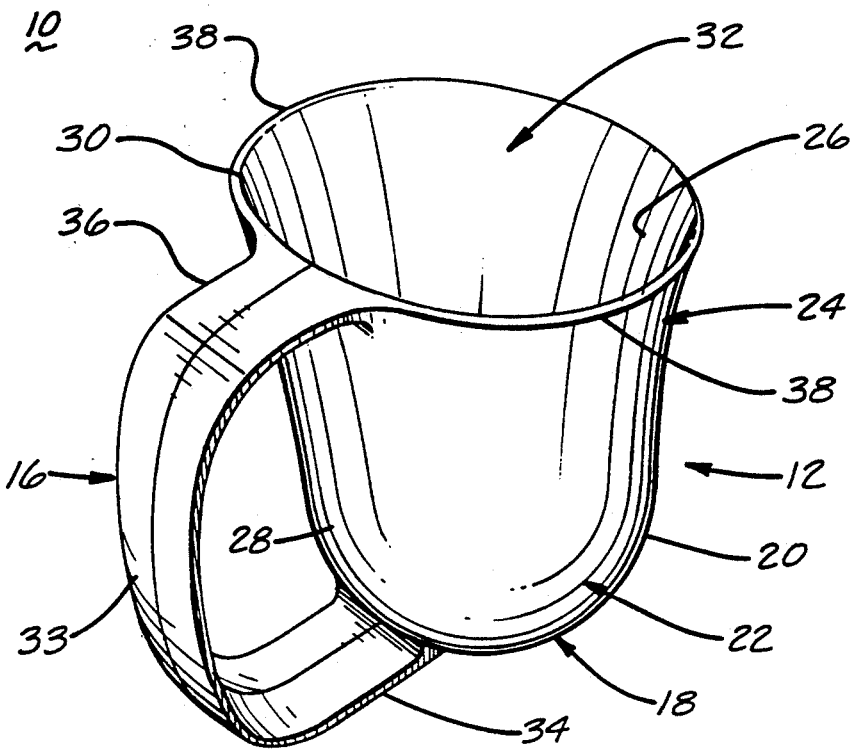
FIG. 1 is a perspective view showing a drinking cup made in accordance with the present invention.

The present invention provides a drinking cup 10 for assisting swallowing, which includes a hollow container portion 12 and a handle 16, as shown in FIG. 1. The container portion 12 has a base 18 and an upwardly projecting sidewall 20. The sidewall 20 has a lower semi-spheroidal portion 22 proximal to the base 18 that flares outwardly to form an upper elliptical portion 24. The sidewall 20 defines an inner surface 26 and an outer surface 28. The sidewall 20 further defines at its apex a rim 30 which bounds an elliptical aperture 32.

Figure 2:
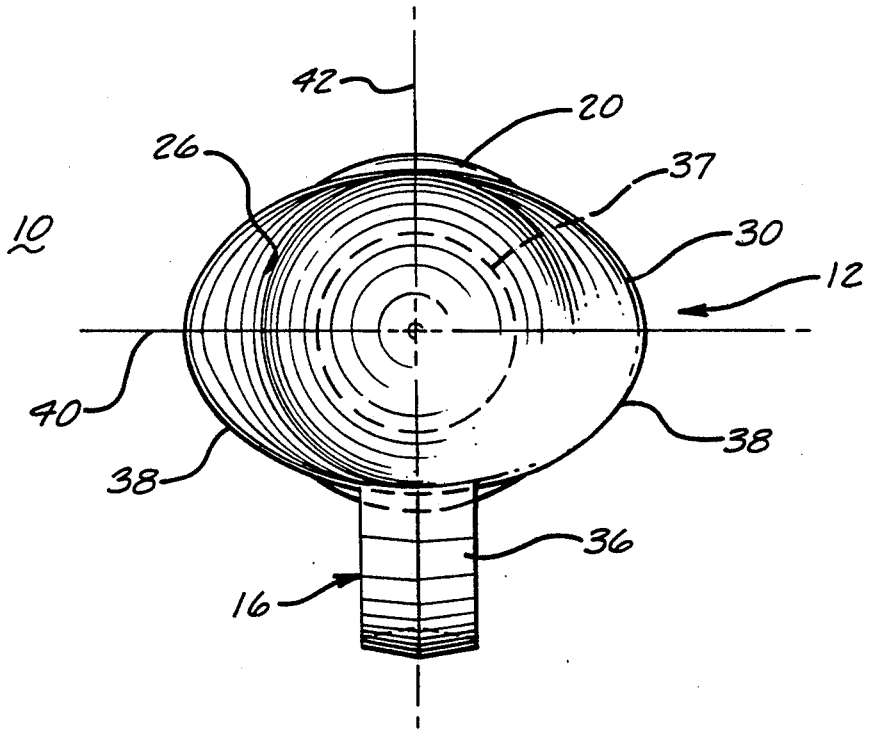
FIG. 2 is a top view of the cup of FIG. 1.
Figure 3:
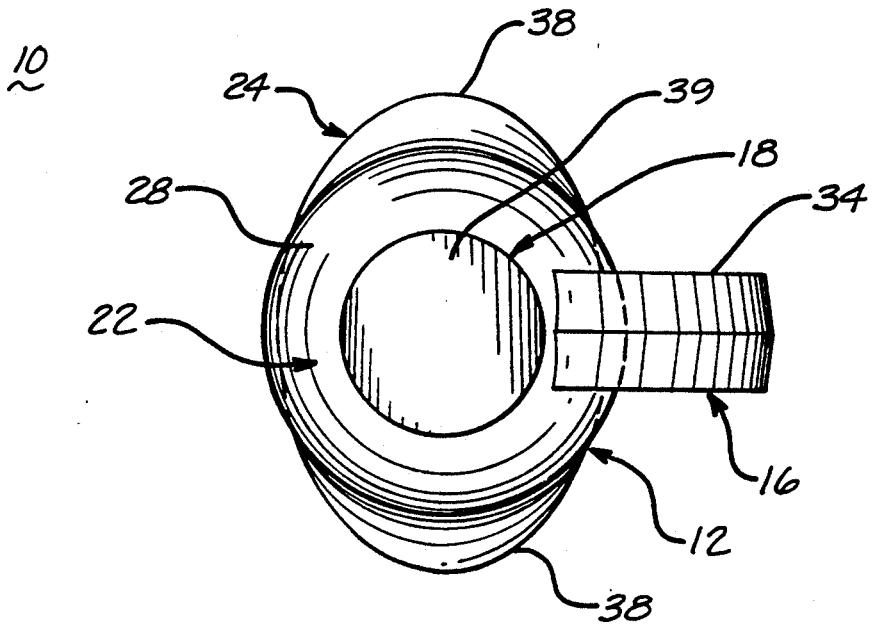
FIG. 3 is a bottom view of the cup of FIG. 1.

Referring to FIGS. 1, 2, and 3, the handle 16 has an elongate center segment 33 and two shorter attachment segments 34 and 36 projecting substantially perpendicularly from the ends thereof. The handle 16 is attached to the container portion 12 by the lower attachment segment 34 proximal at the base 18, and by the upper attachment segment 36 at the edge of the rim 30. The handle 16 is attached to the container portion 12 so that its orientation is 90° out with respect to the major axis of the ellipse formed by the aperture 32. Thus, a plane defined by the center segment 33 and attachment segments 34 and 36 of the handle 16 is oriented orthogonally to the major axis (i.e., long axis) of the elliptical aperture 32.

The configuration of the container portion 12 will now be described more fully, referring to FIGS. 4, 5, and 6. The sidewall 20 projects upwardly from the base 18. The sidewall 20 has a concave, semi-spheroidal portion 22 immediately above the base 18. The container 12 has a circular inner cross section in this region. At an elevation above the base 18 of approximately 10% of the height of the cup 10, the sidewall 20 diverges to form an elliptical cross section, defining the upper elliptical portion 24 that makes up the remaining 90% of the height of the container portion. The point of transition between the lower spheroidal portion 22 and the upper elliptical portion 24 is referred to hereinafter as the inner point of maximum circularity 37 (FIGS. 2 and 5).

The upper elliptical portion 24 of the sidewall 20 is largest at its upper terminus, i.e., the rim 30, which defines the elliptical aperture 32. The aperture 32 has a major axis 40 and a minor axis 42 (FIG. 2). The rim 30 has two narrow-radiused ends 38 for drinking from, which are centered on either end of the major axis 40 of the elliptical aperture 32. The inner surface 26 of the upper elliptical portion 24 tapers inwardly from the rim 30 to the inner point of maximum circularity 37, while retaining an elliptical shape. Thus, when cross sections are taken through the upper elliptical portion 24 of the container portion 12 at various elevations along planes oriented parallel to the rim 30 bounding the aperture 32 (and also parallel to the flat bottom 39 of the base 18), the inner surface 26 of the sidewall 20 defines an ellipse for each cross section. An important feature of the present invention is that the ratio of the major axis to the minor axis of each of the elliptical cross sections formed by the inner surface 26 of the sidewall 20 decreases in the downward direction, i.e., the direction moving from the aperture 32 to the base 18 of the container portion 12. Near the base 18 of the container portion 12, the inner surface 26 of the sidewall 20 thus forms a less elliptical, increasingly circular shape.

The following Table I and FIGS. 7 through 10 illustrate the changing elliptical cross section of the container 12. Each cross section listed in the table is taken along a plane parallel to a plane defined by the aperture 32, at 0.25 inch increments below the rim 30. The dimensions of the major and minor axes are defined by the inner surface 26 of the sidewall 20. For the example provided, the interior of the cup has a height of about 3.5 inches, with the inner point of maximum circularity 37 (i.e., the transition from a circular cross section to an elliptical cross section) being located approximately ¼ inch above the base 18. These dimensions are provided as a non-limiting example of one potential embodiment of the present invention. It should be apparent to those of skill in the art that larger or smaller cups can be made in accordance with the present invention, as desired to accommodate different age drinkers, for example. Additionally, the tapering of the elliptical portion 24 could be altered, so long as adequate clearance is maintained for the user's nose.

TABLE I

Exemplary Major:Minor Axis Ratios Defined by Inner Surface of Sidewall at Different Elevations

| 1. ELEVATIONAL DISTANCE BELOW APERTURE (INCHES) | 2. MAJOR AXIS (inches) | 3. MINOR AXIS (inches) | 4. RATIO OF MAJOR AXIS DIVIDED BY MINOR AXIS |
|---|---|---|---|
| 0 | 3.8 | 2.8 | 1.37 |
| 0.25 | 3.5 | 2.5 | 1.41 |
| 0.5 (FIG. 10) | 3.3 | 2.4 | 1.37 |
| 0.75 | 3.2 | 2.4 | 1.34 |
| 1.0 | 3.1 | 2.3 | 1.33 |
| 1.25 (FIG. 9) | 3.0 | 2.3 | 1.29 |
| 1.5 | 2.8 | 2.2 | 1.25 |
| 1.75 | 2.7 | 2.2 | 1.21 |
| 2.0 (FIG. 8) | 2.5 | 2.1 | 1.18 |
| 2.25 | 2.4 | 2.1 | 1.14 |
| 2.5 | 2.3 | 2.1 | 1.09 |
| 2.75 (FIG. 7) | 2.2 | 2.0 | 1.07 |
| 3.0 | 1.9 | 1.8 | 1.07 |
| 3.25 | 1.4 | 1.4 | 1.04 |

Figure 7:
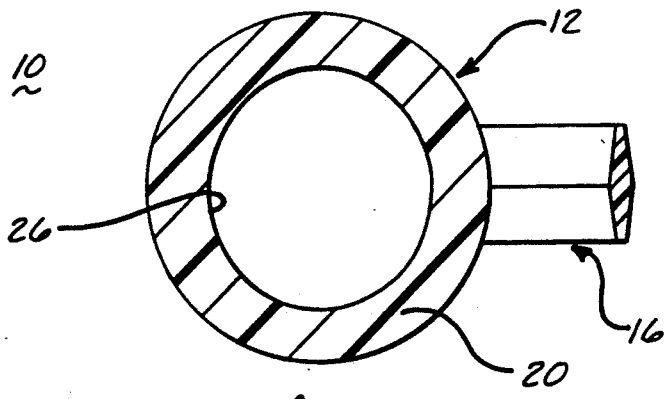
FIGS. 7 through 10 are cross-sectional views taken generally along lines 7—7, 8—8, 9—9, and 10—10, respectively, of FIG. 6.
Figure 8:
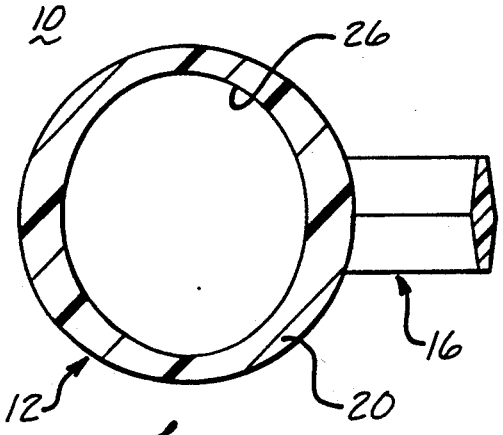
Figure 9:
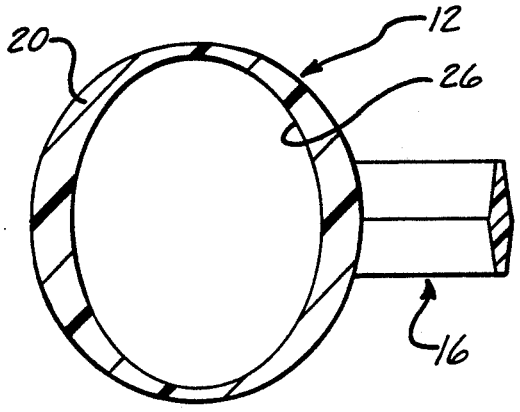
Figure 10:
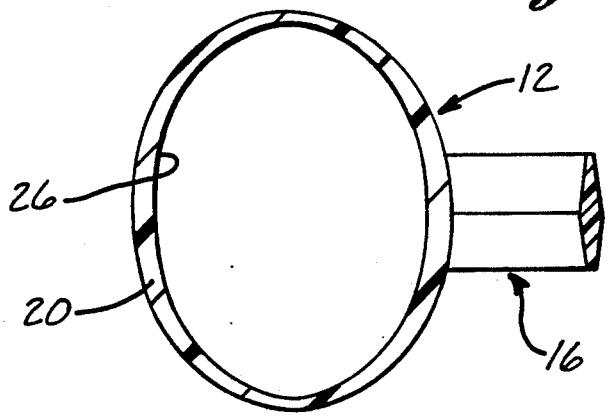

FIGS. 7 through 10 are cross sections taken at increasing heights above the base 18, as indicated in Table 1. FIG. 7 is taken near the transition from the semi-spheroidal lower portion 22 to the upper elliptical portion 24, and thus the inner surface 26 of the sidewall 20 defines a near-perfect circle coinciding with circularity point 37. Progressing from FIG. 7 through to FIG. 10, the inner surface 26 becomes increasingly elliptical. However, the major axes of the elliptical cross sections defined by the inner surface 26 increase at a greater rate with increasing elevation above the base 18, relative to the rate of increase of the minor axes defined by the inner surface 26. Thus, as illustrated in the last column of Table I, the ratio of the major axis to the minor axis increases progressively from the bottom to the top of the cup. As described above, these increasingly elongated ellipses formed by the sidewall 20 inside the container portion 12 cause a channeling effect for liquids which are being drained from the drinking cup 10. This greatly reduces the danger of spillage while the user is drinking and centers the liquid flow as it enters the mouth, while also allowing thickened liquids to flow to the user's mouth. The length of the major axis of the aperture 32 and the upper elliptical portion 24 provides suitable clearance for a user's nose during drinking from the narrow ends 38 of the cup, thus reducing the need for the user to tilt his head back.

Figure 4:
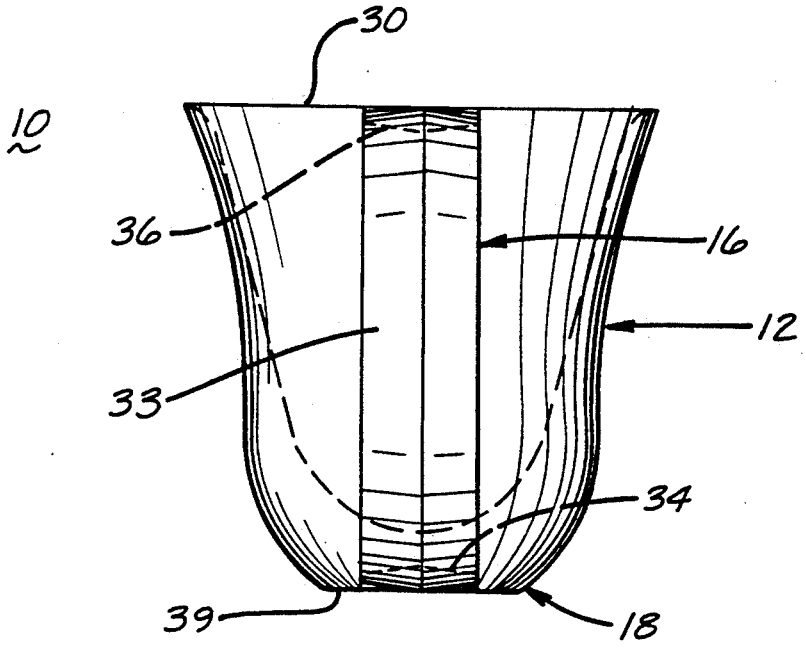
FIG. 4 is a back view of the cup of FIG. 1.
Figure 5:
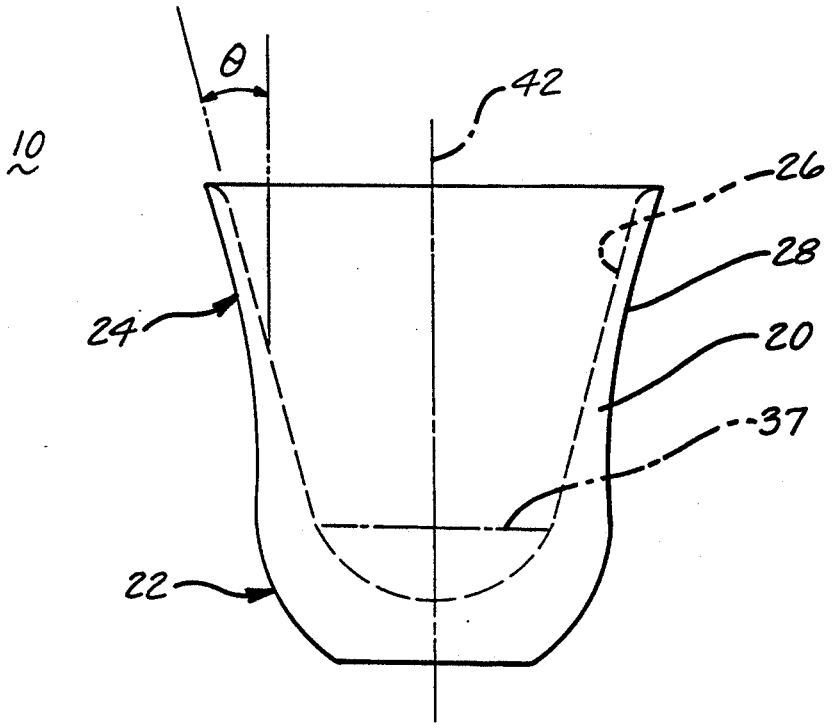
FIG. 5 is a front view of the cup of FIG. 1.
Figure 6:
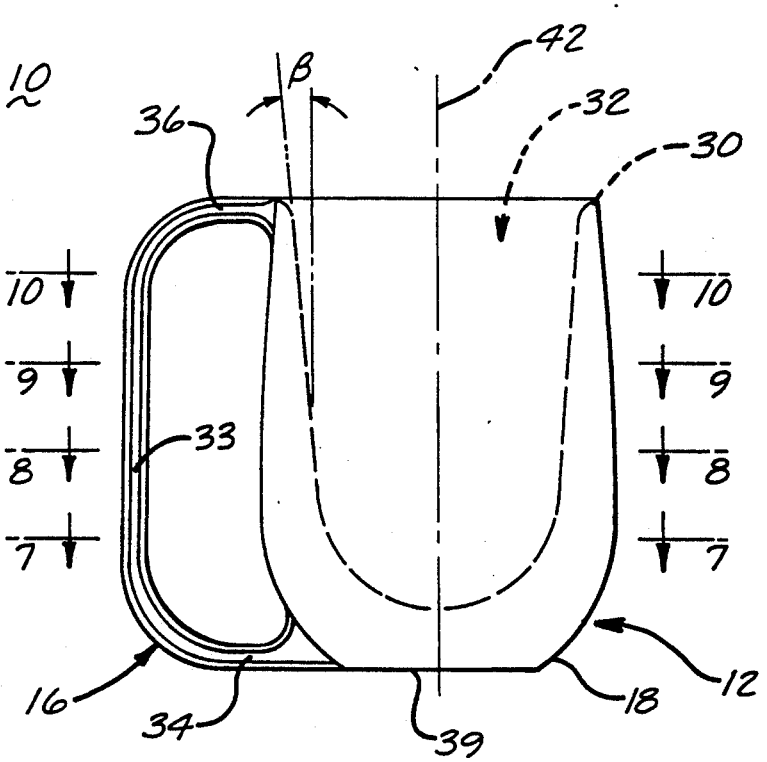
FIG. 6 is a side view of the cup of FIG. 1, the opposite side being a mirror image thereof.

As shown in FIGS. 4, 5, and 6, the outer surface 28 of the sidewall 20 substantially parallels the inner surface 26 along most of the upper elliptical portion 24 below the narrow ends 38 of the rim 30, so that the thickness of the sidewall 20 is minimized in this region. Within the lower semi-spheroidal portion 22, the outer surface 28 of the sidewall 20 extends outward so that it no longer substantially parallels the inner surface 26, causing the sidewall 20 to increase in thickness near the base 18. This formation of the sidewall, which is thickest near the base and thinnest near the rim, helps to balance the cup. Thus cups constructed in accordance with the present invention have increased stability and a reduced incidence of spillage.

The above-described elliptical tapering of the inner surface 26 of the sidewall 20 results in a beverage pouring angle $\theta$ (FIG. 5) defined by the upper elliptical portion 24 below each narrow end 38 of the rim 30 that is predetermined to enhance controlled flow of fluids during drinking. The pouring angle $\theta$ is preferably from 12° to 18°, and most preferably is about 15.1° (for the exemplary dimensions of Table I), as measured relative to a vertical central axis 42 of the container portion 12.

The opposite sides of the upper elliptical portion 24 of the container portion 12, i.e., the long sides of the container portion 24 oriented at either end of the minor axis 42, are less inclined. These long sides of the upper elliptical portion 24 define an angle $\beta$ (FIG. 6) relative to the vertical central axis 42, wherein $\beta$ is from 3 to 7 degrees, and preferably is about 5.3° (for the example of Table I).

The drinking cup 10 is preferably manufactured from a light-weight synthetic plastic, which is non-toxic, durable, and shatter-resistant. However, other materials, such as ceramic, could be used.

As shown in FIGS. 4 and 6, the handle 16 of the drinking cup 10 is attached to the container portion 12 at its base 14 and rim 30, so that the length of the center segment 33 of the handle 16 approximately equals the height of the container portion 12. The length of the center segment 33 is thus sufficient to accommodate four fingers or the palm of an average adult user's hand in a vertical direction within the handle 16. This is useful for elderly users, particularly those with arthritis, who often have stiff joints and may need to use all of their fingers when lifting a drinking cup. The handle 16 has an elongated diamond-shaped cross section (FIG.7) along the entire length, so that it is thicker in the middle than at its edges. The handle 16 is preferably at least three times as wide in the dimension tangential to the outer surface 28 of the container portion 12 as it is thick in the dimension perpendicular to the outer surface 28 of the container portion 12. More preferably, the handle 16 is at least four times wider than it is thick. The wideness of the handle 16 in a direction tangential to the container portion 12 adds stability while drinking and further alleviates the risk of fluid spillage.

The handle 16 of the drinking cup 10 includes horizontal, parallel lower and upper attachment segments 34 and 36, respectively. The segments 34 and 36 are of sufficient length to space the center segment 33 away from the container portion 12 sufficiently to allow at least two fingers of the average adult's hands to be inserted horizontally.

While the preferred embodiment of the invention has been illustrated and described, it will be appreciated that various changes can be made therein without departing from the spirit and scope of the invention. For example, a different handle could be used, as well as a different outer or inner sidewall configuration. This could lead to various kinds of different fluid funneling effects for users with different needs. These variations, however, are not in accordance with the preferred embodiment of the present invention.

The embodiments of the invention in which an exclusive property or privilege is claimed are defined as follows:

1. A drinking cup for assisting swallowing of fluid with high viscosity, comprising a hollow container portion including a base defining an exterior and an interior surface, said interior surface of said base being nonflat, and an upwardly extending sidewall defining at its apex an elliptical aperture, wherein the inner surface of said sidewall defines an ellipse from a cross-sectional perspective at substantially all elevations between the aperture and a point proximate to the base, each cross section being taken along a plane disposed parallel to a plane defined by the aperture, said aperture and said nonflat interior surface of said base being dimensioned so that the aperture accommodates a person's nasal bridge during drinking, whereby substantial backwards angulation of the person's head is not required to substantially dispense all the fluid.

2. A drinking cup in accordance with claim 1, wherein the ratio of the major axis length over the minor axis length for each of the ellipses, defined by the aperture and each of the parallel cross sections, decreases in a direction from the aperture toward the base of said cup.

3. A drinking cup in accordance with claim 2, wherein the elliptical aperture defines narrow-radiused ends, and the outer contour of the sidewall substantially conforms to the inner contour of the sidewall of the container portion below the narrow-radiused ends, except proximal to the base of said container portion, wherein the thickness of the sidewall increases.

4. A drinking cup in accordance with claim 1, further comprising a handle formed on the outer wall of said container portion that is disposed 90° out from the major axis of the elliptical aperture.

5. A drinking cup in accordance with claim 4, wherein the handle is wider in a direction tangential to the container portion of said cup relative to its thickness, the handle defining a ratio of width to thickness of at least 4:1.

6. A drinking cup in accordance with claim 5, wherein the handle includes horizontal, parallel top and bottom segments secured to the outer wall of the container portion of said cup at first and second points adjacent the cup's aperture and base, respectively, and a vertical center segment of the handle connecting the top and bottom segments and extending outward from said container portion sufficiently far to accommodate at least twice the thickness of an average adult user's finger, the vertical distance between the top and bottom segments of the handle being large enough to accommodate four fingers or the palm of an average adult user.

7. The drinking cup of claim 1, wherein an inner surface of the container portion defines a beverage pouring angle of about 15 degrees, measured relative to a vertical axis of the container portion, proximate the aperture.

8. The drinking cup of claim 1, wherein the base defines a bottom exterior surface, and the plane defined by the elliptical aperture is oriented parallel to a plane defined by the bottom exterior surface of the base.

* * * * *